US009574308B2

(12) United States Patent
Castonguay et al.

(10) Patent No.: US 9,574,308 B2
(45) Date of Patent: Feb. 21, 2017

(54) PAVING SLAB FOR FORMING A RANDOM PATTERN

(71) Applicant: OLDCASTLE BUILDING PRODUCTS CANADA INC., Saint-John (CA)

(72) Inventors: Bertin Castonguay, Magog (CA); John Penterman, Montreal (CA); Tamara Evans, Montreal (CA)

(73) Assignee: Oldcastle Building Products Canada Inc. (CA)

( * ) Notice: Subject to any disclaimer, the term of this patent is extended or adjusted under 35 U.S.C. 154(b) by 0 days.

(21) Appl. No.: 14/771,939

(22) PCT Filed: Feb. 20, 2014

(86) PCT No.: PCT/CA2014/050114

§ 371 (c)(1),
(2) Date: Sep. 1, 2015

(87) PCT Pub. No.: WO2014/131119

PCT Pub. Date: Sep. 4, 2014

(65) Prior Publication Data

US 2016/0010288 A1 Jan. 14, 2016

Related U.S. Application Data

(60) Provisional application No. 61/771,158, filed on Mar. 1, 2013.

(51) Int. Cl.
*E01C 5/06* (2006.01)
*B44C 1/28* (2006.01)
(Continued)

(52) U.S. Cl.
CPC . *E01C 5/06* (2013.01); *B44C 1/28* (2013.01); *B44C 3/123* (2013.01); *E01C 9/004* (2013.01);
(Continued)

(58) Field of Classification Search
CPC ..... E01C 5/06; E01C 5/003; E01C 5/005; E01C 9/004; E01C 2201/02; E01C 2201/06; E01C 2201/16; E01C 11/00; B44C 1/28; B44C 3/123
See application file for complete search history.

(56) References Cited

U.S. PATENT DOCUMENTS 2,250,890 A * 7/1941 Longfellow ..... E01C 5/06 404/2
4,016,692 A * 4/1977 Jordan ..... B28B 17/0018 52/314

(Continued)

FOREIGN PATENT DOCUMENTS

GB 1445617 A 8/1976
GB 2450739 A 1/2009

OTHER PUBLICATIONS

Extended European Search Report in related EP Application 14757318, International Application No. PCT/CA2014/050114, dated Jul. 14, 2016, 5 pages.

(Continued)

*Primary Examiner* — Abigail A Risic
(74) *Attorney, Agent, or Firm* — Kilpatrick Townsend & Stockton LLP

(57) ABSTRACT

A paving slab. The paving slab has a unitary body made of concrete-based material, the body having sidewalls extending between top and bottom faces, providing the body with a thickness. The top face is provided with longitudinal false joints defining rows extending from a first to a second side of the unitary body. The first side has a staggered outline and the second side has a stepped outline, the first and second sides being able to engage with respective first and second sides of an adjacent slab shaped as the paving slab, but rotated by 180 degrees. When several of the slabs are
(Continued)

assembled on a surface, it creates an illusion that the surface is covered by individual plank pavers randomly assembled.

19 Claims, 11 Drawing Sheets

(51) Int. Cl.
*B44C 3/12* (2006.01)
*E01C 9/00* (2006.01)

(52) U.S. Cl.
CPC ..... *E01C 2201/02* (2013.01); *E01C 2201/06* (2013.01); *E01C 2201/16* (2013.01)

(56) References Cited

U.S. PATENT DOCUMENTS 5,054,957 A 10/1991 Johnson, II
5,281,047 A * 1/1994 Skaug ..... E01C 5/22 404/31
7,632,036 B2 12/2009 Dupuis
7,647,738 B2 * 1/2010 Nasvik ..... B32B 3/06 52/384
8,002,494 B2 8/2011 Ciccarello
D686,351 S * 7/2013 Elmaagacli ..... D25/151
8,820,022 B1 * 9/2014 Riccobene ..... E01C 5/06 404/34
2003/0126821 A1 7/2003 Scherer et al.
2003/0200713 A1 * 10/2003 McStay ..... B44C 1/28 52/311.2
2006/0150557 A1 * 7/2006 Eisermann ..... B32B 3/06 52/578
2007/0137128 A1 * 6/2007 Viau ..... B44C 5/0415 52/388
2011/0061323 A1 * 3/2011 Schwarz ..... E04F 13/0864 52/314
2014/0363591 A1 * 12/2014 Unn ..... B44F 9/02 428/17
2015/0056013 A1 * 2/2015 Brown ..... E01C 5/005 404/35

OTHER PUBLICATIONS

International Search Report in related International Application No. PCT/CA2014/050114, dated May 8, 2014, 3 pages.

* cited by examiner

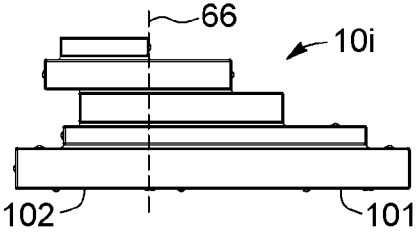
FIG. 9A
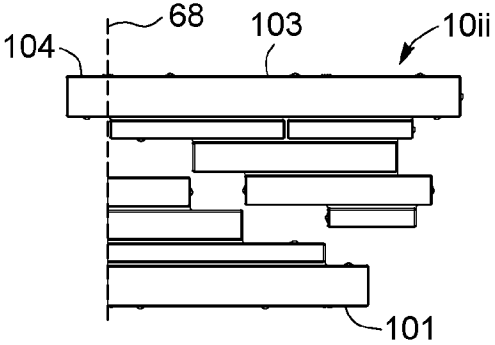
FIG. 9B
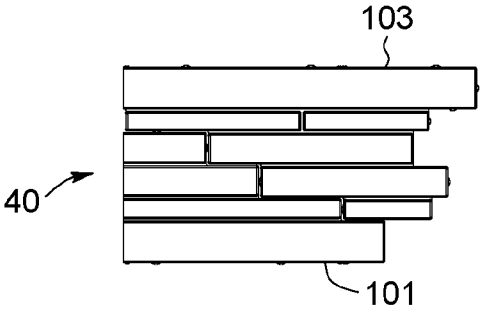
FIG. 9C
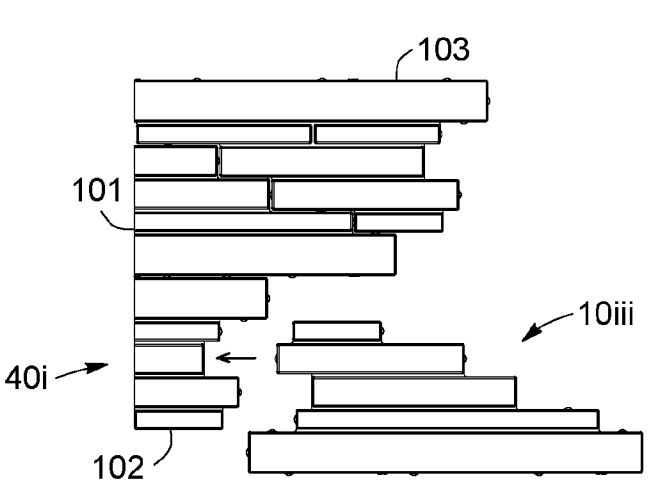
FIG. 9D
FIG. 9E
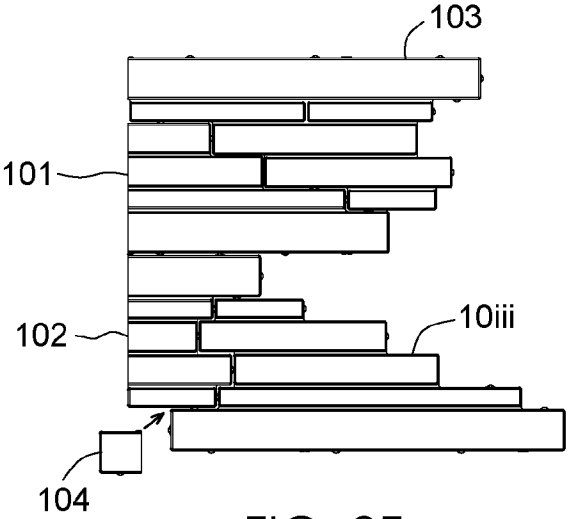
FIG. 9F

PAVING SLAB FOR FORMING A RANDOM PATTERN

CROSS-REFERENCE TO RELATED APPLICATION

This application is the U.S. national phase of International Application No. PCT/CA2014/050114 filed on Feb. 20, 2014, and published on Sep. 4, 2014 as International Publication No. WO 2014/131119 A1, which application claims priority to and the benefit of U.S. Provisional Application No. 61/771,158, filed on Mar. 1, 2013, the contents of all which are incorporated herein by reference in their entireties.

FIELD OF THE INVENTION

The present invention relates to the field of masonry and paving works and installations. More particularly, it concerns a concrete-based slab for creating a layout which looks like it has been made from several long and narrow distinct planks pavers, forming an irregular or "randomized" pattern.

BACKGROUND OF THE INVENTION

It is often desirable to have a stone masonry or paving covering with a visually appealing pattern. It is further desirable to vary this pattern so as to create one which is, or seems to be, irregular or "random" to the viewer.

Such irregular patterns are known in the art. They can be created by skilled masons or stoneworkers who can cut bricks, stones, or rocks into any shape and lay them upon the ground with no predetermined logic. Such an irregular pattern may require significant time and labor to produce, and is thus not suitable for all installations.

In the related fields of ceramics and hardwood flooring, there is a trend to create flooring out of rectangular tiles or planks of different sizes, and to arrange such tiles or planks to form a random floor pattern.

There is a need in the landscaping industry for paving units which would provide a similar effect. It would be desirable to recreate such random patterns for outside flooring, such as with cement or concrete-based paving units. Long and narrow paving units made of concrete-based material are not well-adapted for landscaping, since they lack flexural strength and resistance to heavy loads. Both commercial and consumer paving units must comply with standards specifying the load charge the units must be able to withstand, and the flexural strength they must have. In order to comply with such standards, current solutions, such as plank pavers, are offered in thicker pavers, and are thus more expensive. Combining individual plank pavers of different widths and lengths is often not possible or too complex, since they come in different thicknesses. The longer and narrower pavers are typically thicker than wider and/or shorter pavers, since the long and narrow pavers must be able to provide the same flexural strength capacities than shorter and/or wider pavers, and this can only be achieved by increasing their thickness.

There is thus a need to provide a paving solution for forming a paved surface which appears to be made of several distinct rectangular paving units of different lengths. It would also be desirable that the joints between the paving units appear to be located randomly over the paved surface.

Finally, it would be desirable to provide a paving or masonry unit which would allow people with limited or no masonry skills to create a suitably irregular floor pattern from masonry units that could be manufactured quickly and in abundance, easily transported, and assembled without difficulty.

SUMMARY OF THE INVENTION

The present invention relates to a plurality of paving slabs. Each of the paving slabs comprises a unitary body made of concrete-based material, the body having sidewalls extending between top and bottom faces, providing the body with a thickness. The top face is provided with longitudinal false joints defining rows extending from a first side to a second side of the unitary body.

The first and second sides are incongruent, i.e. not congruent. The rows comprise top and bottom rows. The first side has a staggered outline with at least one recess and at least one tooth. The second side has a stepped outline from the top row to the bottom row, the first and second sides being able to couple or mesh with respective first and second sides of adjacent paving slabs, rotated by 180 degrees. The recess and tooth of the paving slab serve to interlock with the respective tooth and recess of an adjacent paving slab. The staggered and stepped outlines of the slabs create the illusion, when the plurality of paving slabs are assembled on a surface, that the surface is covered by individual plank pavers randomly assembled.

In an exemplary embodiment, all of the paving slabs have an identical outer contour.

In an exemplary embodiment, at least some of the slabs have transverse false joints on their top face defining bars within a row.

In an exemplary embodiment, the plurality of paving slabs forms at least two different configurations of slabs. The different configurations are determined by the location of the transverse false joints on the top face of the slabs, resulting in different lengths of planks. All slabs in a given configuration have the same transverse false joint location.

In an exemplary embodiment, each of the slabs comprise between four and six rows, the rows having respective lengths and widths. In this exemplary embodiment, at least three of the lengths are different and at least two of the widths are different.

In an exemplary embodiment, the lengths of the rows within each slab are different.

In an exemplary embodiment, a pair formed by assembling a first slab with a second slab, rotated by 180 degrees, with both the first and second slabs comprising n rows, creates a set of n+1 rows. In this exemplary embodiment, the pair is preferably formed by aligning the top row of the first paving slab with a row adjacent to the bottom row of the second paving slab.

In an exemplary embodiment, a pair of first and second paving slabs, each with n rows, creates a set of n+2 rows.

In an exemplary embodiment, each of the paving slabs comprises five rows. The top and fourth rows have a first width, the second and third rows have a second width, and the remaining bottom row has a third width, where the first, the second and the third widths are all different from one another.

In an exemplary embodiment, the recess of the first side is formed between two teeth.

In an exemplary embodiment, the outer contour of the slabs has a shape reminiscent of a trapezoid. In another possible embodiment, the outer contour has a shape reminiscent of a triangle.

In an exemplary embodiment, at least some of the paving slabs comprise at least one opening formed within at least one of their rows. The opening(s) extend(s) from the top face to the bottom face of the paving slabs.

In an exemplary embodiment, the rows are sized, shaped and configured to create, when the plurality of paving slabs are assembled on a surface, openings in between the slabs.

In yet another exemplary embodiment, at least some of the sidewalls are provided with spacers having a width corresponding to the width of the longitudinal false joints. It is also possible for the paving slabs to be provided with indicators on some of the sidewalls, for indicating where to perform a line of cut in the paving slabs.

According to yet another aspect of the invention, a single paving slab is provided. The paving slab comprises a unitary body made of concrete-based material. The body has sidewalls extending between top and bottom faces, providing the body with a thickness. The top face is provided with longitudinal false joints defining rows extending from a first to a second side of the unitary body. The first and second sides are incongruent. The rows include top and bottom rows, the rows having respective lengths and widths. At least two of the widths are different, the first side having a staggered outline with at least one recess and at least one tooth, and the second side having a stepped outline from the top row to the bottom row.

The first and second sides are able to couple with respective first and second sides of adjacent slabs, the adjacent slabs having the same shape, but rotated by 180 degrees. The recess and tooth of the paving slab serve to interlock with the respective tooth and recess of one of the adjacent paving slabs. The staggered and stepped outlines of the slabs create an illusion, when the slabs are assembled on a surface, that the surface is covered by individual plank pavers randomly assembled.

BRIEF DESCRIPTION OF THE DRAWINGS

Other objects and advantages of the invention will become apparent upon reading the detailed description and upon referring to the drawings in which:

FIGS. 9A to 9F show different steps of for assembling paving slabs according to an exemplary embodiment of the invention, some of the slabs being cut for placement along a linear edge of the surface to be covered.

LIST OF THE NUMERICAL REFERENCES

Figure 1:
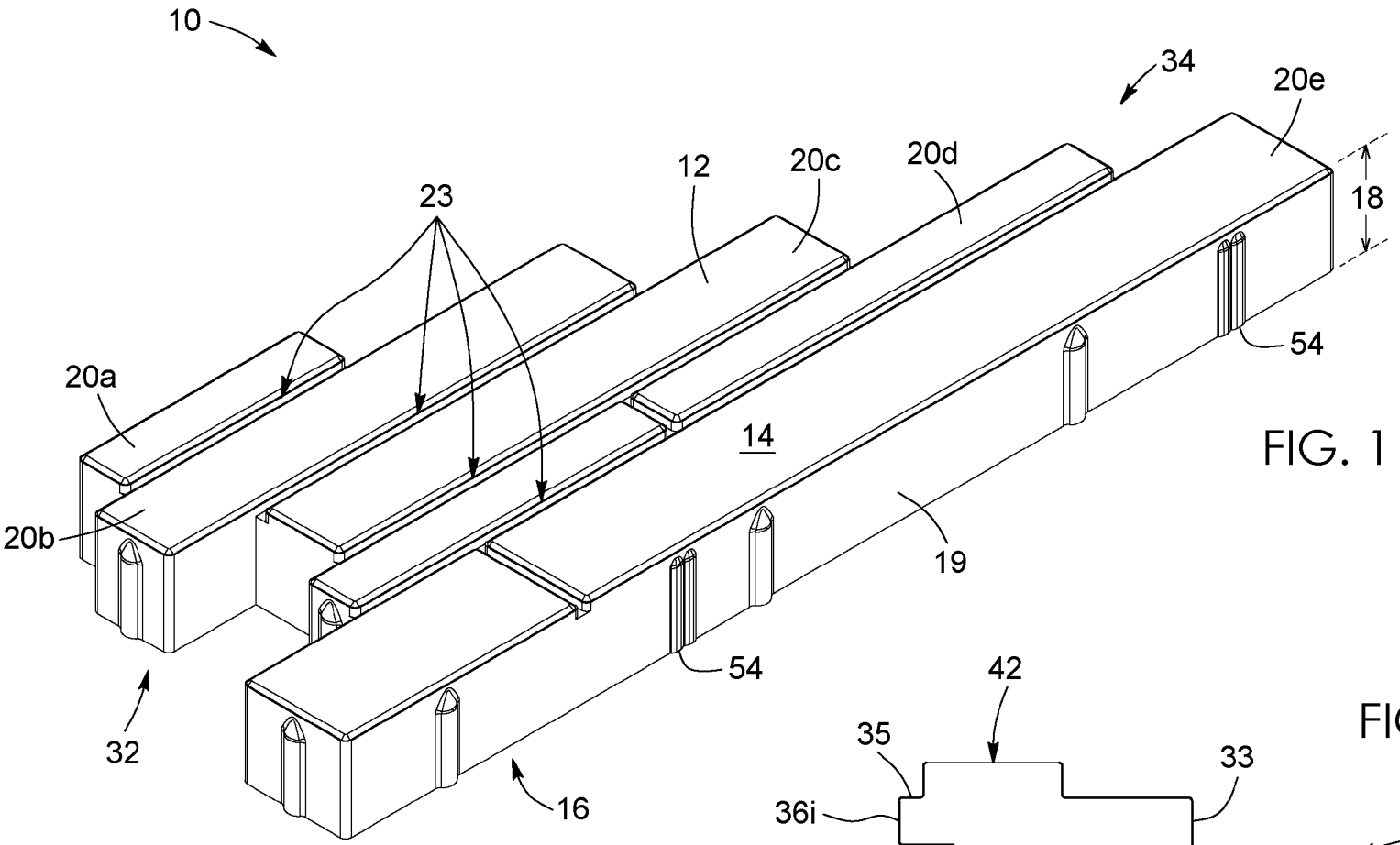
FIG. 1 is a perspective view showing a paving slab having five rows, according to an exemplary embodiment of the present invention.

10 paving slab or paving unit
12 unitary body
14 top face
16 bottom face
18 thickness
19 sidewalls or lateral sides
20 rows or layers of a paving slab
21 bars
22 transversal false joint
23 groove or longitudinal false joint
30 set or pair of paving slabs
32 first side of slab
33 diagonal/stepped outline
34 second side of slab
35 staggered outline
36 tooth
38 recess
40 row of paired units
42 outer contour
44 length
46 width
48 opening within a slab
59 opening in between slabs
50 spacers
52 width of spacers and false joints
54 indicators
60 paving installation layout
62 trapezoidal shape
64 triangular shape
67 line of cut
68 straight edge of surface to cover
70 board
80 surface

DETAILED DESCRIPTION OF EMBODIMENTS OF THE INVENTION

In the following description, the same numerical references refer to similar elements. Furthermore, for the sake of simplicity and clarity, namely so as to not unduly burden the figures with several references numbers, not all figures contain references to all the components and features of the present invention and references to some components and features may be found in only one figure, and components and features of the present invention illustrated in other figures can be easily inferred therefrom. The embodiments, geometrical configurations, materials mentioned and/or dimensions shown in the figures are optional, and provided only as examples.

Figure 1A:
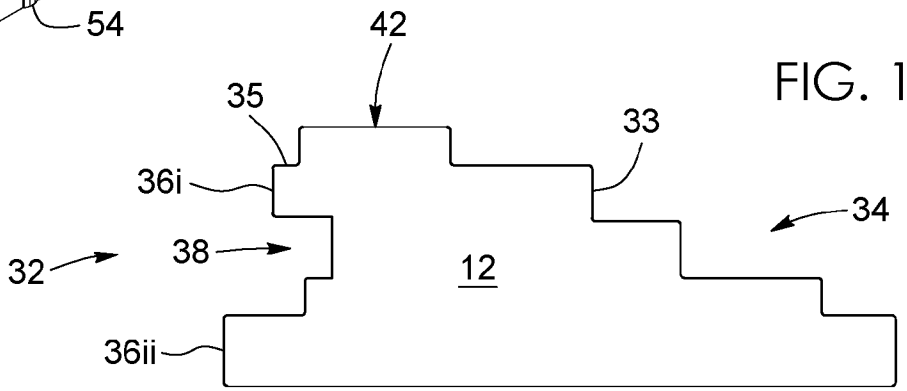
FIG. 1A is a top view of the paving slab of FIG. 1, showing only the contour of the slab.

Referring to FIGS. 1 and 1A, an example of a paving slab 10, or paving unit, is shown. The paving slab 10 has a unitary body 12 made of concrete-based material. The concrete-based material is preferably dry-cast concrete, but other types of concrete can be used, such as wet concrete. The slabs 10 are preferably molded from cementitious or concrete-based material. The body 12 has sidewalls 19 extending between top and bottom faces 14, 16, providing the body 12 with a thickness 18. The top face 14 is provided with longitudinal false joints 23 defining rows 20*a*, 20*b*, 20*c*, 20*d* and 20*e* extending from a first side 32 to a second side 34 of the unitary body 12. Rows can also be referred to as "layers". The rows can vary in length, and also preferably in width.

When the slab 10 is manufactured, each row is defined by notching the still-wet slab 10 in the appropriate area, where each notch creates a false joint, defining two adjacent rows. In the example shown in FIG. 1, row 20*a* is next to row 20*b*, which is next to row 20*c*, and so forth. The manner by which the rows are made next to each other can vary, so as to create the desired level of randomness or irregularity. In the example shown in FIG. 1, none of the rows perfectly overlap one another, which results in a misalignment of the ends of the rows 20, which will advantageously allow to "lose" the joints or interconnections between adjacent slabs 10 when forming a pavement.

A row preferably has a rectangular, elongated outline. The term "elongated" refers to the lengthened or narrowed configuration of the rows. For example, the rows can have a length over width ratio of 3:1 or higher. The rows 20 are essentially designed, shaped, and positioned to resemble individual paving units, such as those made from cement, for example, when in reality they are manufactured as one integral piece. The unit 10 thus appears as a series of distinct plank pavers. Of course, the slabs 10 can have a top surface 14 which is either smooth or textured, so as to imitate natural stones for example.

With regard to the exemplary paving slab shown in FIG. 1, the first side 32 corresponds to the left side and the second side 34 corresponds to the right side of the slab, viewed from the top. The first and second sides 32, 34 are incongruent. By "incongruent", it means that the side 32, 34 are not congruent, i.e. the first and second sides 32, 34 are not superposable so as to be coincident throughout. The sides 32, 34 are also asymmetrical, or not symmetrical, i.e. the first and second sides 32, 34 exhibit no symmetry. It is advantageous to provide the slabs with incongruent and asymmetrical sides, since it helps provide a layout with an even more random look than if the two sides were congruent and/or symmetric.

As best shown in FIG. 1A, the first side 32 has a staggered outline 35 with at least one recess 38 and at least one tooth 36*i*, while the second side 34 has a stepped outline 33, which preferably extends from the top row 20*a* to the bottom row 20*e*. The recess 38 is preferably formed between two protruding teeth 36*i*, 36*ii*, in order to provide a better interlock with adjacent paving slabs, and in order to prevent the slabs from shifting or moving after being installed. It can also be noticed that the outer contour 42 of this exemplary slab has a shape reminiscent of a trapezoid. Of course, other shapes can be considered as well, such as a shape reminiscent of a triangle, for example.

The term "staggered" as used to describe the outline, or profile, 35 of the first side 32 refers to the alternating arrangement of rows next to each other. In the slab of FIG. 1A, on the left side of the slab, the rows both project away from, and recede into, the ends of adjacent rows.

The second side 34 of each slab 10 defines a substantially diagonal and stepped profile or outline 33. The term "diagonal" refers to the "step-like" or "cascading" contour of the second side 34. The profile 33 can be ascending or descending, as required. The stepped profile 33 contributes to the effect of irregularity that defines a layout obtained by coupling and assembling several slabs together, by staggering the vertical or perpendicular joints away from each other. The stepped outline allows creating longer rows or planks within the same paving unit, compared to slabs formed with opposed staggered sides. The slabs can be coupled in pairs along their diagonal profile, so that they can fit on a pallet for packaging and transportation purposes.

Referring to FIG. 1A, the paving slab 10 has an outer contour 42 which is preferably the same as all paving slabs of a paving system, for simplifying the coupling and assembly of the slabs for landscaping workmen. It can thus be appreciated that the molds allows for the mass manufacture of slabs 10, where each has an identical shape or outline. This advantageously helps to reduce manufacturing costs while still providing the desired irregularity.

Figure 4:
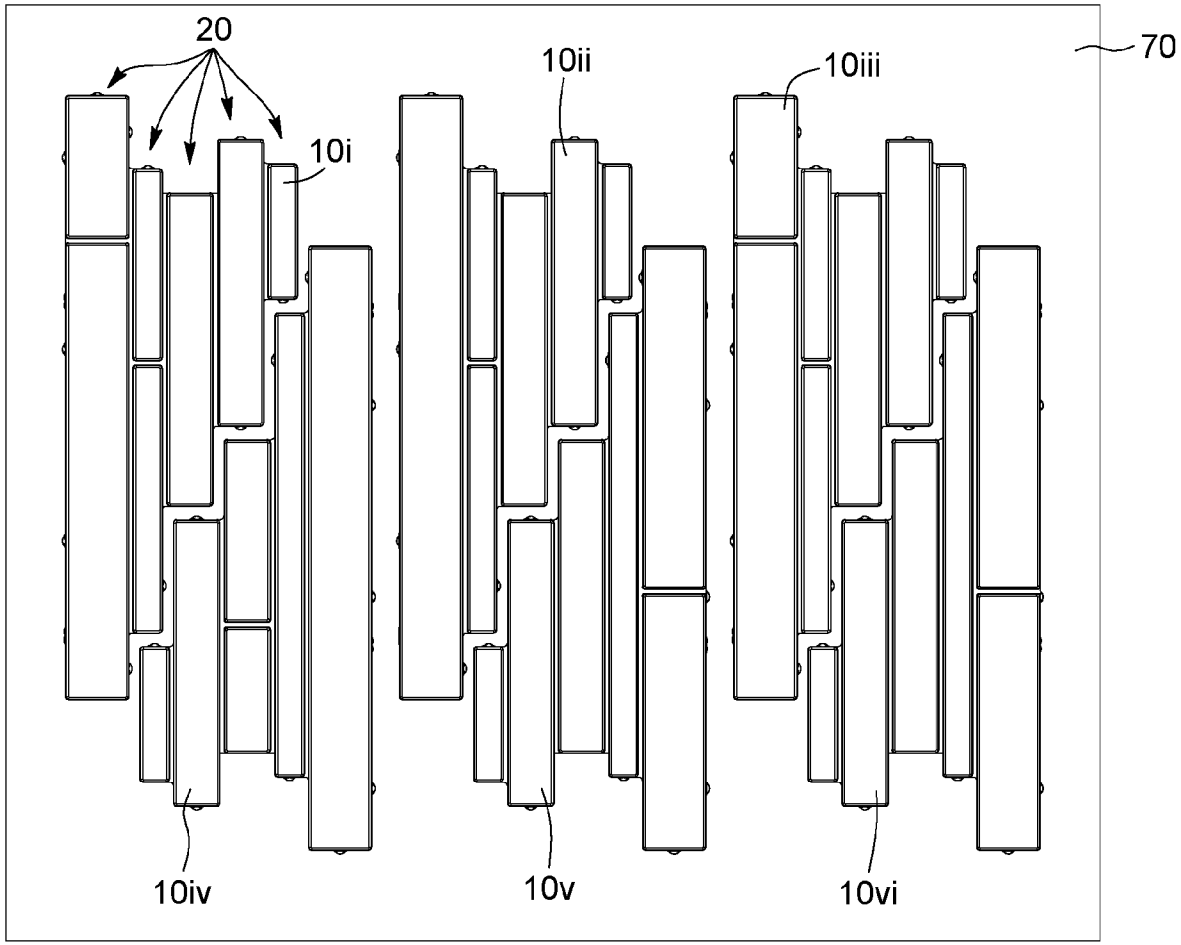
FIG. 4 is a top view of different paving slabs laid out on a board, such as the ones shown in FIG. 2.

As best show in FIG. 4, another advantage of the stepped profile of the slabs is that it allows arranging the slabs such that they occupy more surface area on a board or pallet when they are manufactured, transported and/or stored. In order to reduce costs, the space occupied by stacked boards of slabs in warehouses and in transport trucks must be minimized, and one way to achieve this is by maximizing the surface of the boards occupied by the slabs.

Figure 3:
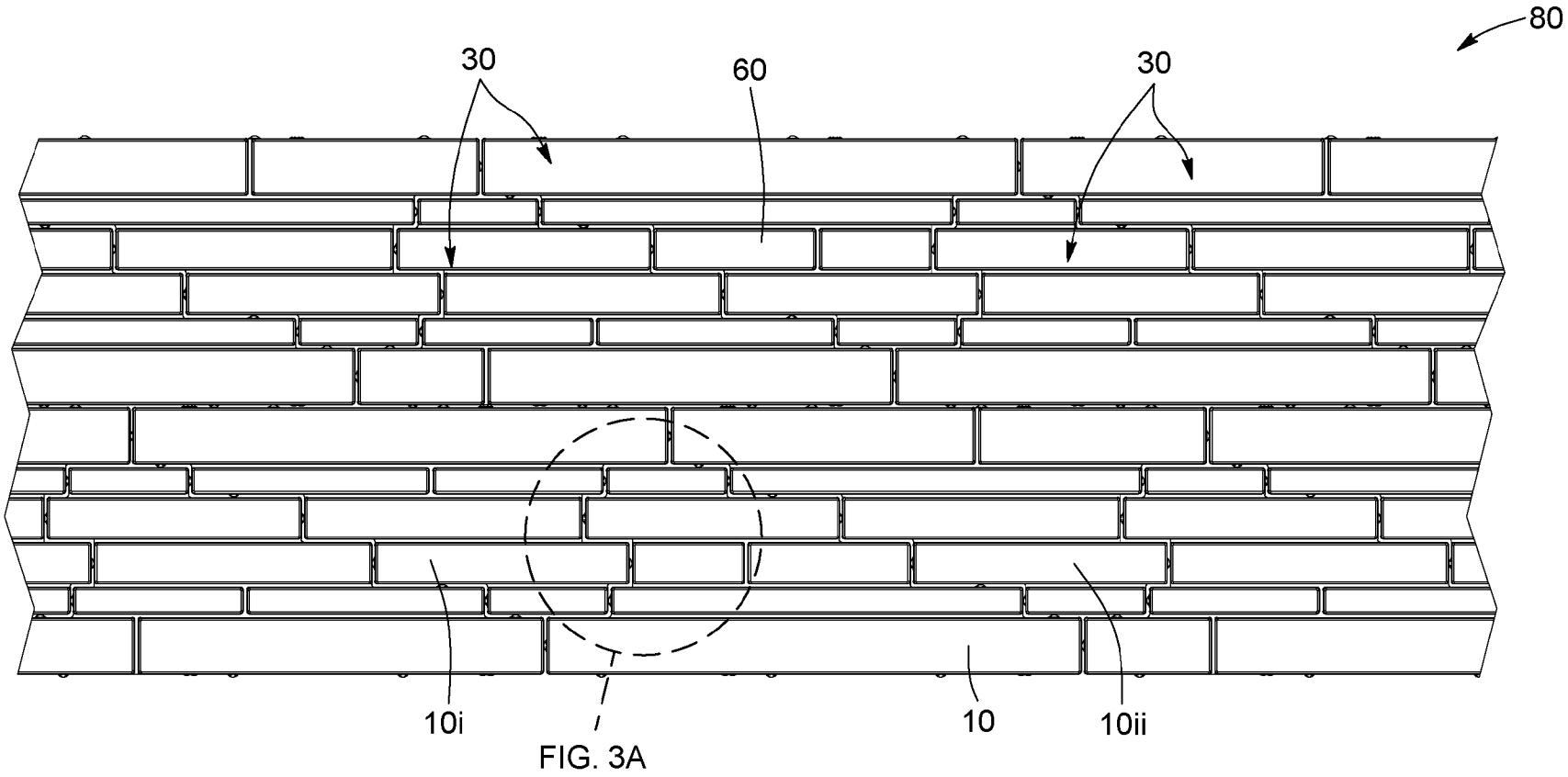
FIG. 3 is a top view of a surface covered with paving slabs, such as the ones shown in FIG. 2.
Figure 3A:
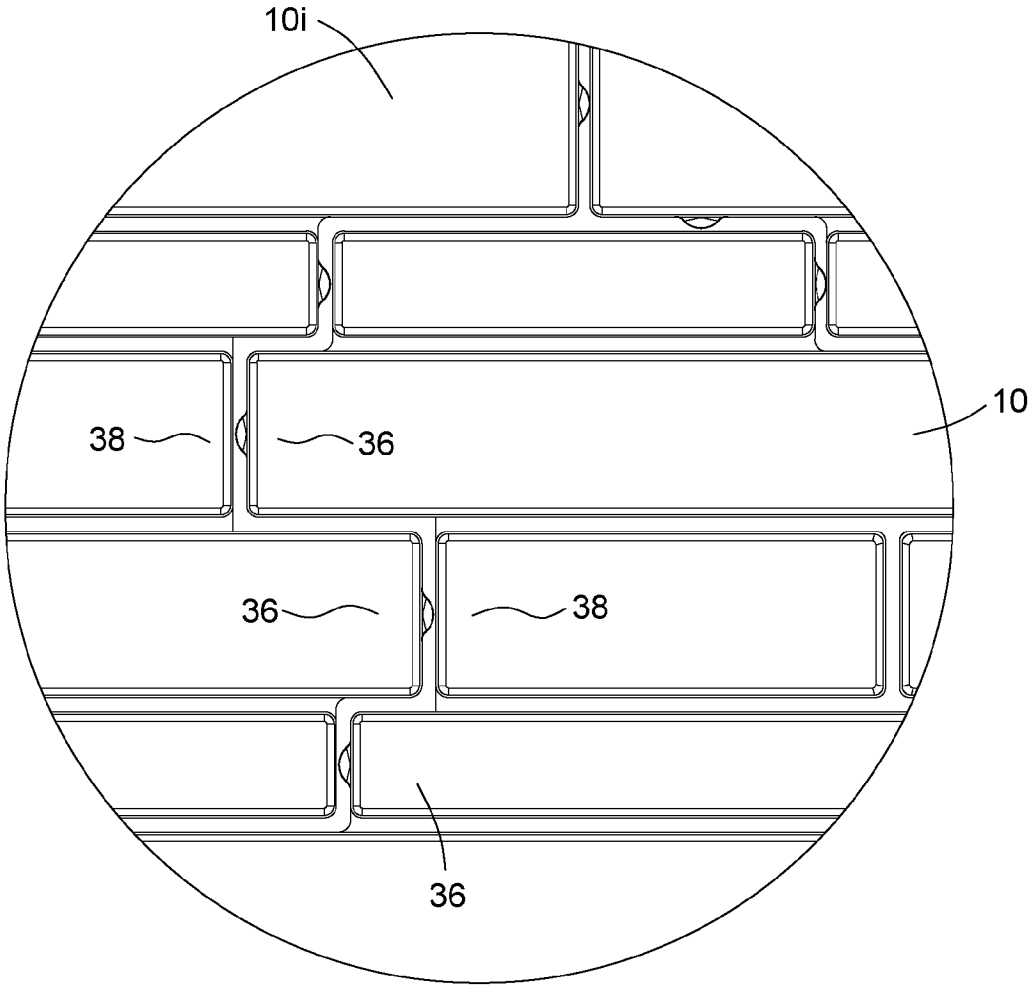
FIG. 3A is an enlarged view of a portion of FIG. 3.

Referring to FIGS. 3 and 3A, the first and second sides of a paving slab 10 are able to couple, or mesh, with respective first and second sides of adjacent paving slabs 10*i*, 10*ii*, rotated by 180 degrees, the recess 38 and teeth 36 of the paving slab 10 serving to interlock with the respective teeth 36 and recess 38 of an adjacent paving slab 10*i*. When paired, the slabs form a floor layout set 30. The floor layout set 30 is a portion, part, fraction, etc. of the total masonry floor layout 60. It is thus understood that the alignment or combination of multiple sets 30 of slabs 10 forms the layout 60. The slabs need to be alternately rotated, and their sides 32, 34 aligned with the sides 32, 34 of adjacent slabs. The staggered and stepped outlines of the slabs 10 create the illusion, when a plurality of paving slabs are assembled on the surface 80, that the surface 80 is covered by individual plank pavers randomly assembled. Advantageously, this relatively simple arrangement of mass-produced slabs forms a layout 60 having a pattern that looks irregular, or at the very least, whose repetitiveness is difficult to detect by the casual observer. The non-linear nature of the first sides of the slabs provides them each with recesses 38 and teeth 36. The recesses can be any recess or space formed when one layer is shorter than an adjacent layer, and into which the teeth from separate adjacent slab can fit. As shown in FIG. 3A, the teeth 36 are complementary to the recess 38, so that the slab 10 can be mated with adjacent unit 10*i*.

Advantageously, the paving slab 10 allows for an installer, stone worker or mason to create a layout 60 that will appear as if the slabs were assembled at random from several rectangular units, such as plank pavers. The term "irregular" as used herein signifies that observer looking at the layout 60 will have the impression that there is no logical, repeating, or constant pattern to the layout 60. As such, the terms "random", "haphazard", "arbitrary", "designless", and other similar terms could be used to describe the layout 60. The variation in size and profile of rows contributes to the irregular appearance of the layout 60. The layout 60 itself can be any terrace, paving, parquet, or other similar cover for the floor or ground. The layout can also refer to masonry works for walls or vertical surfaces.

One of the main advantages provided by the paving slab 10 such as described, is that it allows creating a layout with longer rows than if the layout was formed by individual, discrete plank pavers. It also allows "managing" a single thickness, since the rows are part of a single unitary body. By merging the rows in a single paving slab, the rows can be made longer since the unitary body of the slab is able to withstand load charges substantially greater than individual rectangular plank pavers. A single slab according to the invention also exhibits higher flexural strength compared to several individual plank pavers.

In contrast, individual plank pavers of varying length often come in varying thicknesses, in order to comply with the industry standards such as the standard A231.1-06 in Canada and the standard EN1339 in Europe. It thus becomes difficult if not impossible to combine plank pavers of different lengths and thicknesses within the same layout, as one would need to dig furrows of different depth to accommodate individual pavers of different thicknesses.

Figure 1B:
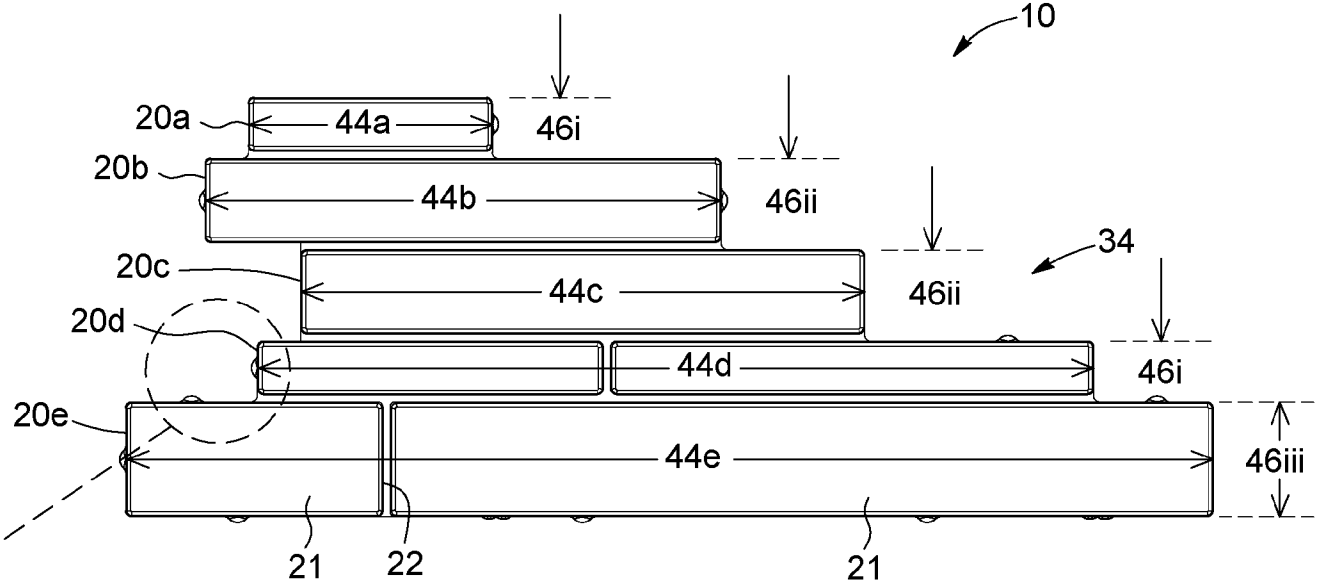
FIG. 1B is a top view of the paving slab of FIG. 1.

Referring now to FIG. 1B and FIG. 4, the slab 10 can be provided with transverse false joints 22 on its top face 14, defining bars 21 within a row 20. As shown in FIG. 4, the paving slabs 10 have different configurations, depending on the location of the transverse false joints. In other words, the different configurations are determined by the location of the transverse false joints 22 on the top face of the slabs. In the present case, the slabs 10*i* and 10*iii* have the same transverse false joint configuration. The slabs 10*v* and 10*vi* exhibit the same transverse false joint pattern, which is different than the one from slabs 10*i* and 10*iii*. Slabs 10*iv* and 10*ii* each have a distinct transverse false joint configuration. Transverse false joints 22 can be created in different rows 20, introducing a variance in their appearance and contributing the effect of irregularity and randomness when they are assembled. The false joints 22 can be indents or notches in the slabs, for example of about 10 mm thick, to give the appearance of separate bars or sub-units 21. The false joints 22 can be varied from slab to slab, further increasing the effect of irregularity.

Figure 1C:
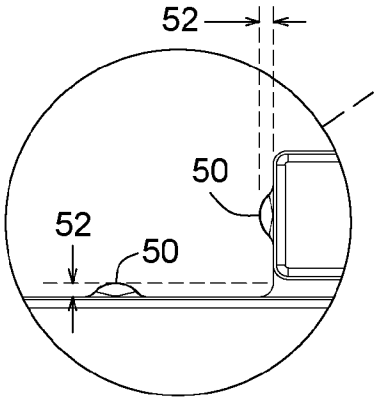
FIG. 1C is an enlarged view of a portion of FIG. 1B.

Referring to FIG. 1B, and also to FIG. 1C, at least some of the sidewalls 19 are provided with spacers 50. The spacers 50 have a width 52 corresponding to approximately the width of the longitudinal false joints, and also preferably corresponding to approximately the width of the transverse false joints 22. Spacers are preferably shaped as protuberances protruding from the sidewalls. They ensure that the spacing between neighboring units is equivalent to the width of the false joints, thus increasing the illusion that the rows of the different slabs are individual plank pavers.

Referring to FIGS. 1B and 4, this embodiment of the paving slab include five rows 20, the rows 20 having respective lengths and widths. In alternate embodiments, it is possible for the slabs to include more or less rows, but it is preferred that the slabs include between four and six rows. In this specific embodiment, at least three of the lengths are different and at least two of the widths are different. More specifically, the paving slab 10 includes five rows 20*a*-20*e*, two of the rows 20*a*, 20*d* having a first width 46*i*, two other of the rows 20*b*, 20*c* having a second width 46*ii*, and the remaining row 20*e* having a third width 46*iii*. The first, the second and the third widths 46*i*, 46*ii*, 46*iii* are all different from one another. The advantage of such a distribution of row widths is that it contributes to the irregularity of a layout created from assembling several of such slabs 10. The lengths 44*a*-44*e* of the rows 20*a* to 20*e* are also all different, which further increases the randomness of a layout formed by assembling several of the slabs. While it is preferred that all rows have different lengths, it is possible in other embodiments of the slabs that one or more rows have the same length.

Figure 2:
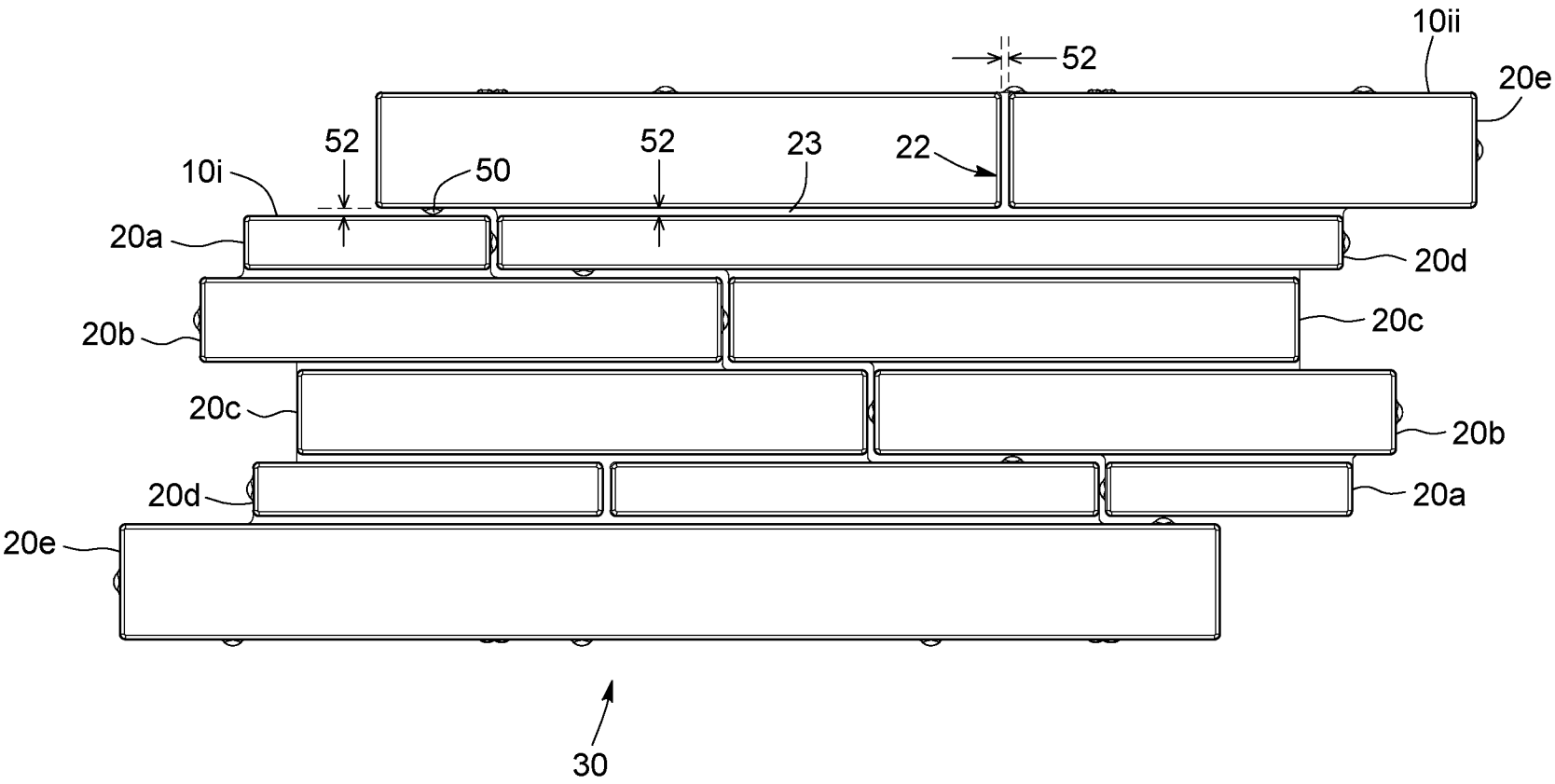
FIG. 2 is a top view of a pair of paving slabs, being coupled with one another, one of the slabs being rotated by 180 degrees relative to the other slab, according to another exemplary embodiment.

Referring now to FIG. 2, a pair 30 of slabs 10*i*, 10*ii* is shown. The pair 30 is formed by assembling a first paving slab 10*i* with a second paving slab 10*i*, rotated by 180 degrees. Both first and second paving slabs 10*i*, 10*ii* include five rows and the set created by pairing the slabs has six rows. As such, a slab having n rows can be paired with another slab having n rows, to form a set having n+1 rows. With the present embodiment, the pair 30 is formed by aligning the top row 20*a* of the first paving slab 10*i* with the row 20*d*, which is adjacent to the bottom row 20*e* of the second paving slab 10*ii*. This arrangement is possible since rows 20*a* and 20*d* have the same width, and since rows 20*b* and 20*c* also have the same width. Advantageously, the pair 30 of slabs 10*i*, 10*ii* forms an extra (i.e. sixth) row, even though each slab 10*i*, 10*ii* only has five rows 20. By eliminating an actual sixth row, more slabs 10 can be made on a board during manufacturing. Another important advantage is that five-row units are less heavy than six-row units. Weight is an important aspect to consider for paving or masonry units, since a single worker must preferably be able to handle and manipulate the slabs. This optional embodiment of the slab 10 further allows for the use of fewer rows 20 while still providing suitably irregularity. This is in contrast with conventional teachings which assume that irregularity can be increased with more rows, rather than with fewer. As can be noticed, the shape of the paired slabs, when mated along their stepped or diagonal outline, is reminiscent of a parallelogram, and slightly rectangular, which allows to occupy more space when paired units are placed on a rectangular pallet for storing and/or transportation purposes. Providing one side of the slab 10 with a diagonal or stepped profile also provides a non-trivial advantage: during the manufacturing process, the slabs must be clamped together in order to be wrapped and palletized. The diagonal profile allows the slabs to interlock or engage more easily during the clamping process.

Figure 5:
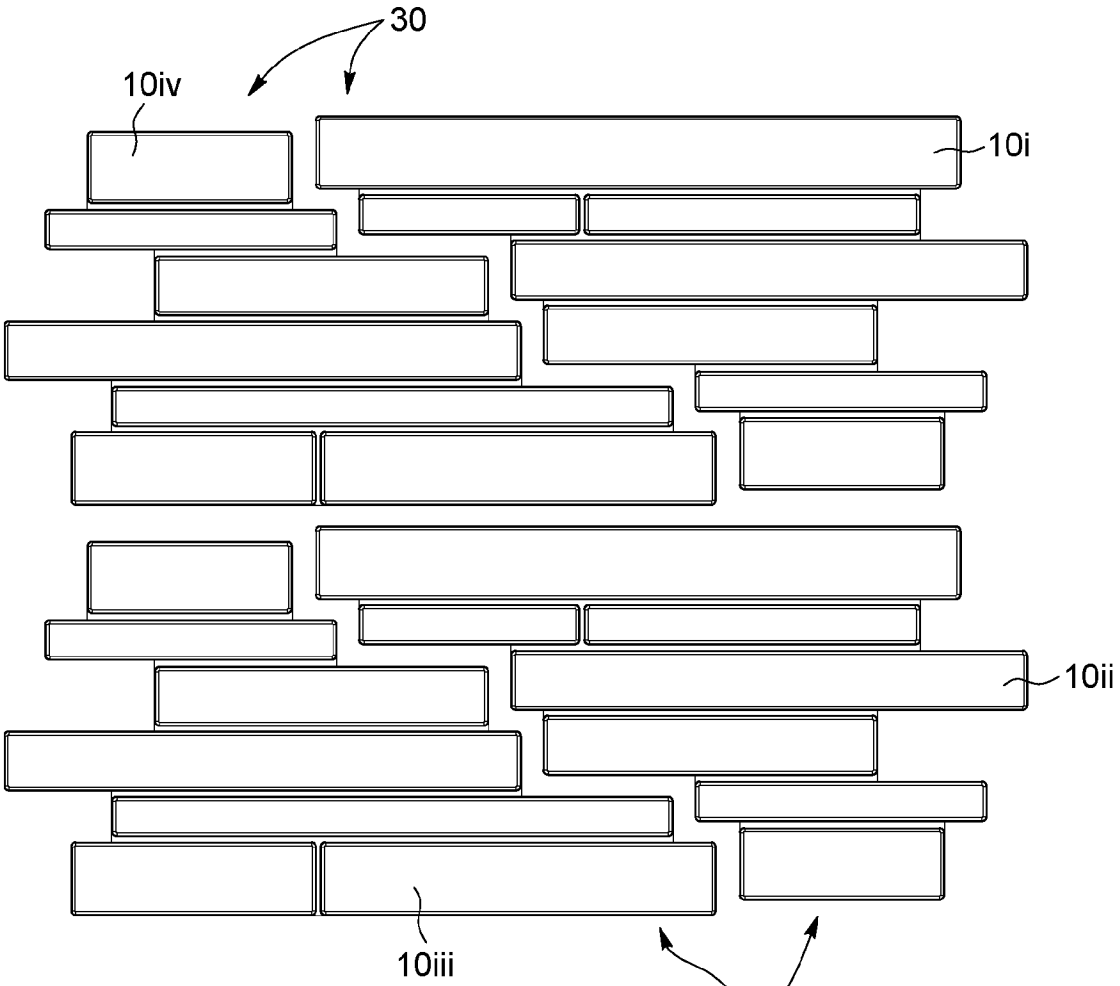
FIG. 5 is a top view of four paving slabs, according to another exemplary embodiment of the present invention, the slabs having six rows.

Referring to FIG. 5, a different embodiment of the slabs is shown. The slabs 10*i*-10*iv* include six different rows which provide a set 30 with six rows, when the units are paired. Each of the units 10*i*, 10*ii*, 10*iii* and 10*iv* can also vary from each other by placing the transverse false joints at different locations on the top surface of the slabs.

Figure 6:
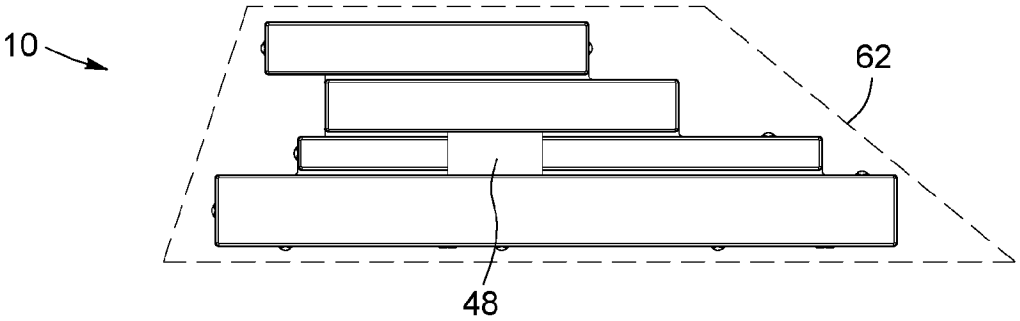
FIG. 6 is a top view of a paving slab according to an exemplary embodiment of the invention, the slab including an opening within a row.
Figure 6A:
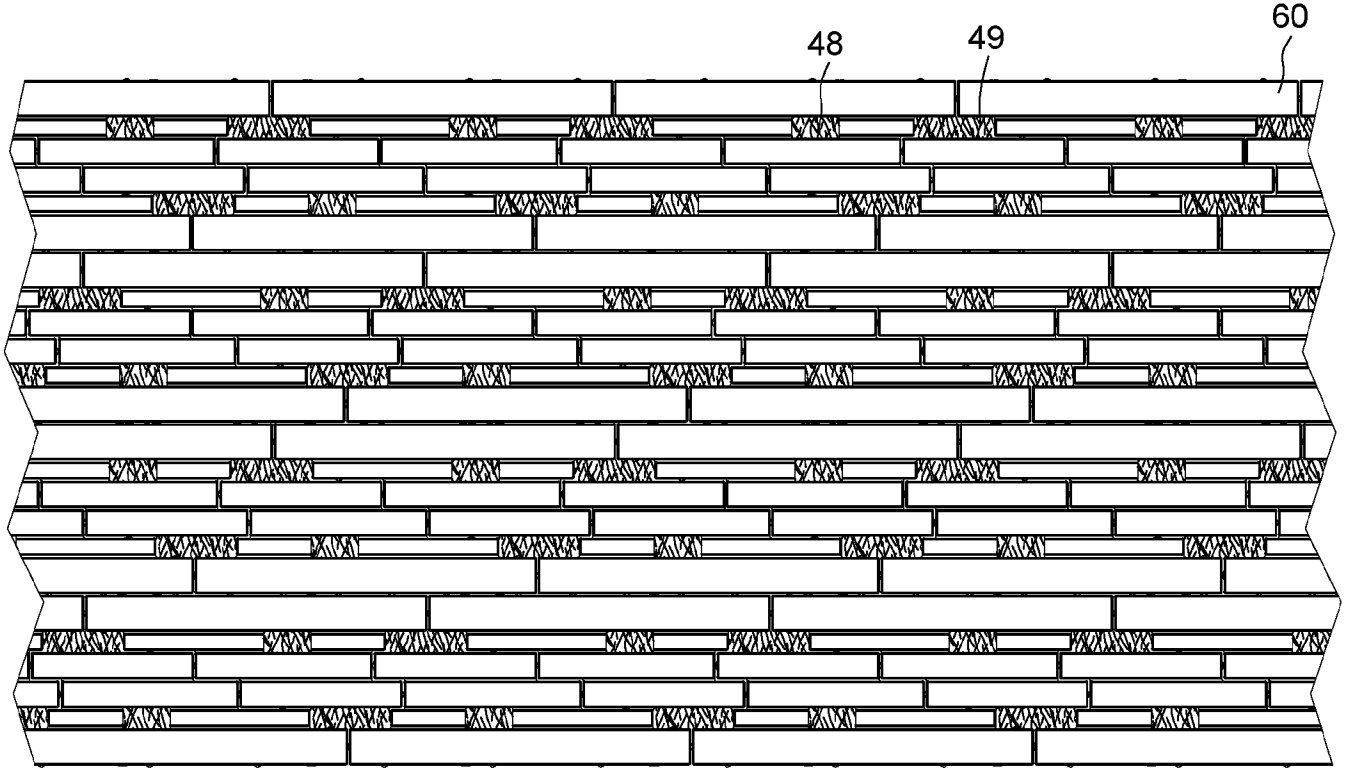
FIG. 6A is a top view of a surface covered with a plurality of slabs such as the one shown in FIG. 6.

Referring to FIGS. 6 and 6A, yet another embodiment of a paving slab is shown. In this embodiment, the slab 10 includes only four rows, and one of the rows contains an opening 48. In the present case, the opening is formed within the penultimate row from the bottom side of the slab. Of course, it is possible for a slab to contain more than one opening. The opening 48 extends from the top face to the bottom face of the paving slab 10, allowing, when in use, to grow grass, moss or other vegetation within the opening. The opening can also be used to receive wood chips, gravel or pebbles therein. Of course, any other suitable material can be put in these openings. The slab 10 of this embodiment has a shape 62 reminiscent of a trapezoid, which contributes to losing a repetitive pattern when the slabs are laid out in a pavement, as shown in FIG. 6A. It will also be noticed that with this embodiment of the paving slabs, the rows are sized, shaped and configured to create openings 49 in between the slabs 10, when the plurality of paving slabs 10 are assembled to form the layout 60. These openings 49 can also serve to grow moss or grass or any other plants. Openings 48 and 49 advantageously provides a slab which is environmentally friendly, as it allows to limit or reduce the creation of heat islands by the inclusion of vegetation and plants within a pavement formed with the slabs. It will be appreciated that a pair of such slabs creates a set of six rows. Thus, in the present case, the rows are sized, shaped and configured such that slabs having n rows can form pairs of n+2 rows.

Figure 7:
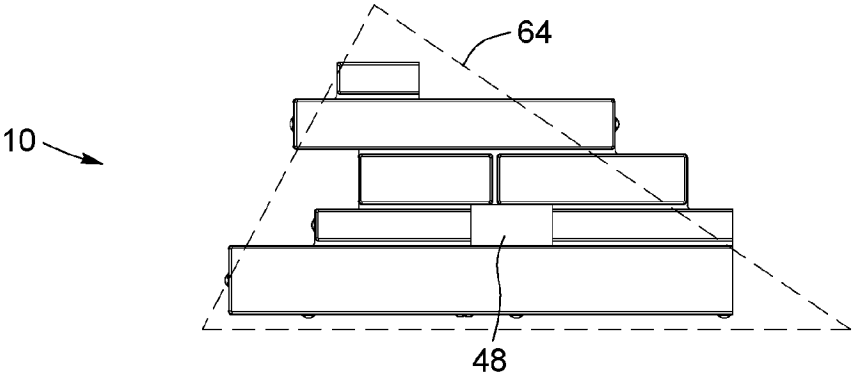
FIG. 7 is a top view of another paving slab according to an exemplary embodiment of the invention, the slab also including an opening within a row.
Figure 7A:
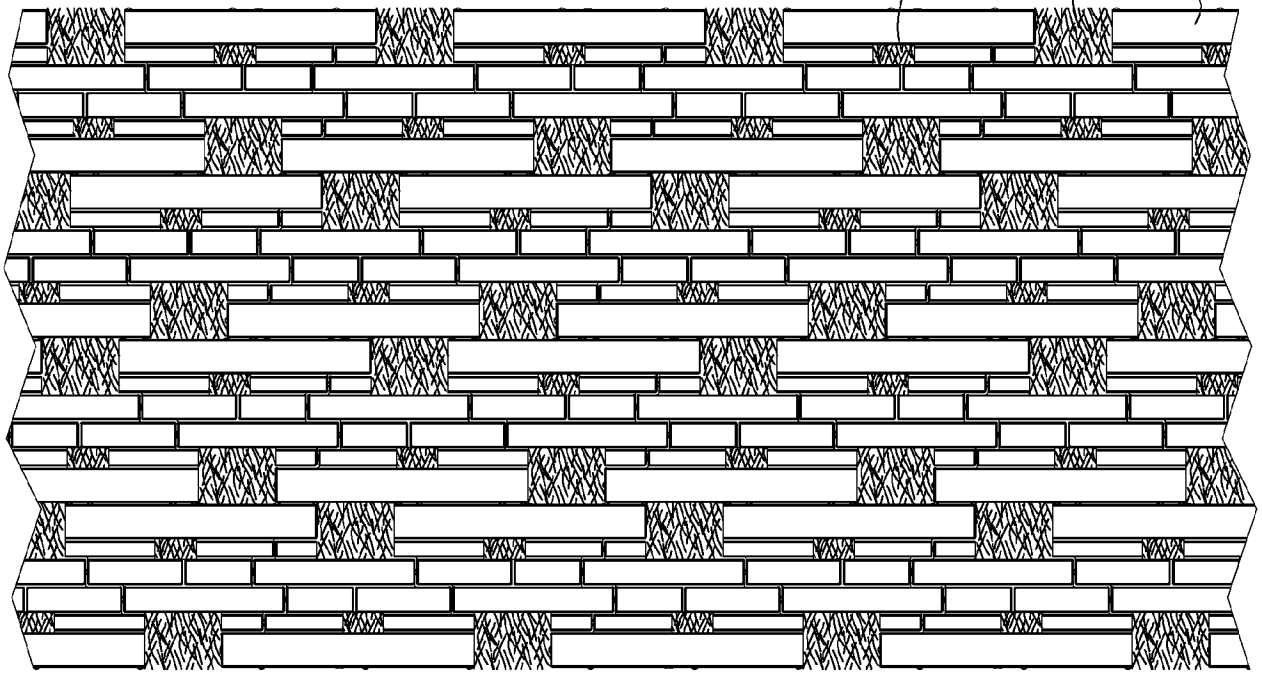
FIG. 7A is a top view of a surface covered with a plurality of slabs such as the one shown in FIG. 7.

FIGS. 7 and 7A show yet another embodiment of the paving slabs. In this case the slabs have five rows, with an opening 48 in the penultimate row. The shape 64 of the slab resembles, or is reminiscent, of a triangle. When paired, the slabs 10 form a set of six rows (i.e. n+1 rows), creating wider openings 49 than the ones of the slab of FIG. 6.

Figure 8:
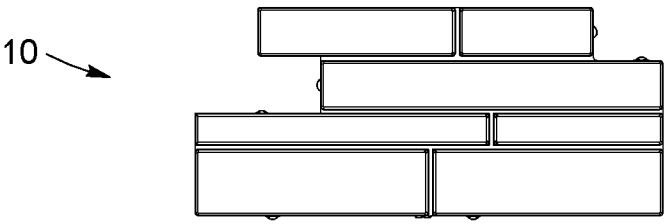
FIG. 8 is a top view of another paving slab according to an exemplary embodiment of the invention, the slab creating openings between slabs when assembled with other similar paving slabs.
Figure 8A:
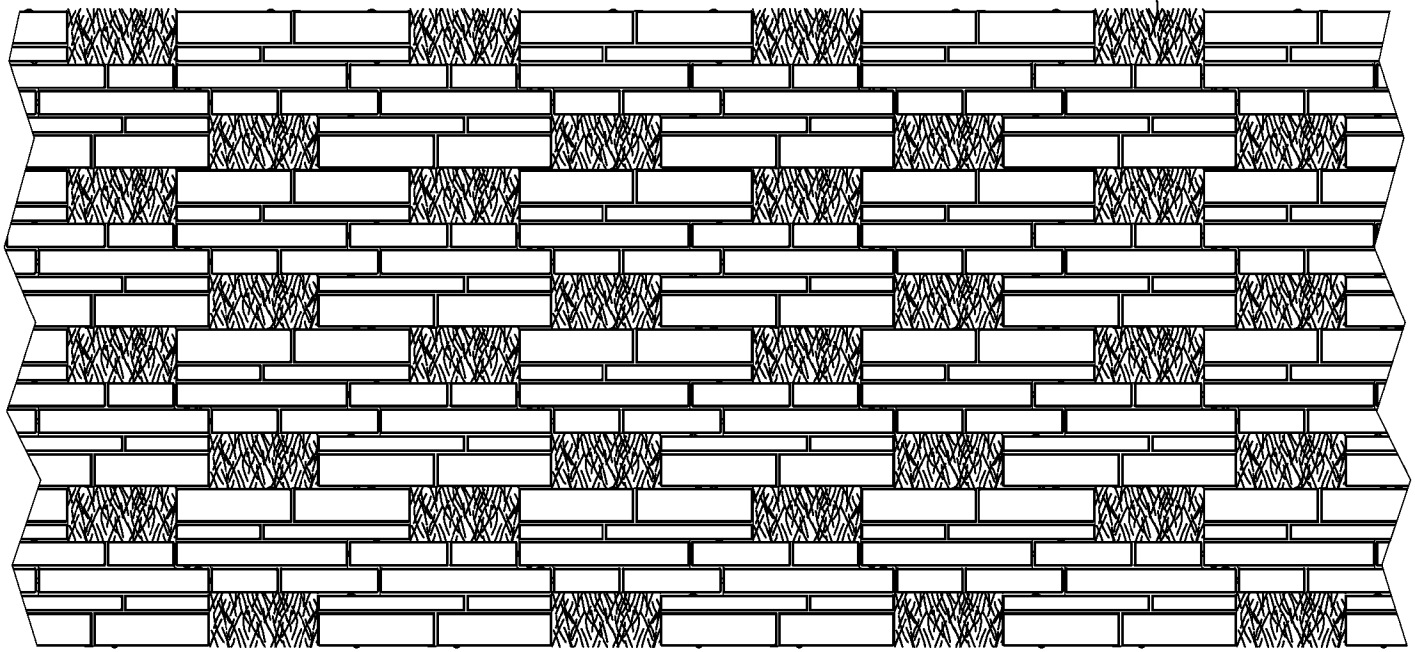
FIG. 8A is a top view of a surface covered with a plurality of slabs such as the one shown in FIG. 8.

In FIGS. 8 and 8A, a different embodiment of the slabs is shown. The stepped outline is provided on the first two rows on the right side of the slab, the slab having four rows. Just as for the embodiment of FIG. 6A, this slab of four rows can form pairs or sets of six rows. In this case however, the slab does not include any openings within the row, but the rows are shaped and configured to create openings 49 in between the joined slabs, extending over the width of two rows. Of course, it would be possible in other similar embodiments of the slab to include one or more openings within one or more rows.

Figure 1D:
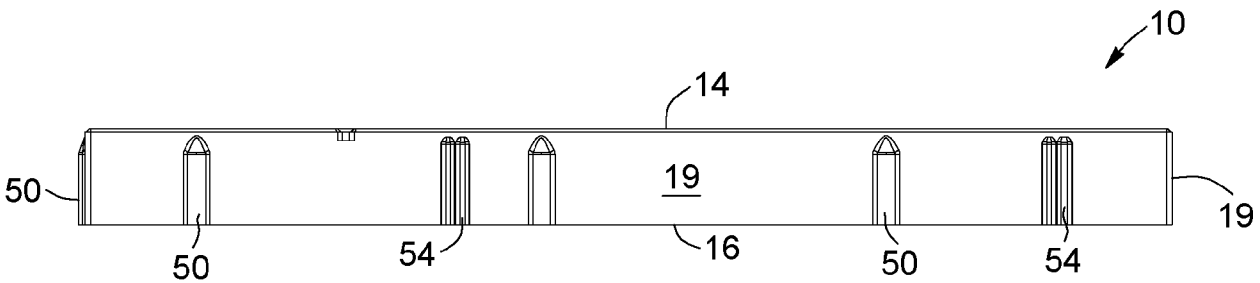
FIG. 1D is a side view of the paving slab of FIG. 1.

Turning to FIGS. 9A to 9F, and also to FIGS. 1 and 1D, some of the sidewalls 19 of the slabs 10 are preferably provided with indicators 54. These indicators, or markers, serve to indicate where to perform a line of cut in the paving slabs 10, when starting a pavement from a straight edge 68, as shown in FIGS. 9A-9B. The markers or indicators can take the form of protuberances; in the embodiment shown, the indicators 54 are shaped as two narrow protruding fingers, but of course other shapes can be considered. It is also possible that the indicators be made with paint, or as narrow recesses; these are merely two examples among many possibilities. In order to begin a pavement along a straight edge of a surface, the first step consists of cutting the slab along a cutting line 66, which is aligned with an indicator 54, and orthogonal to the rows of the slabs, as shown in FIG. 9A. The slab 10*i* is thus cut into piece 101 and piece 102. The second step consists of cutting a new slab 10*ii* along line 68, which is aligned with indicator 54, resulting in pieces 103 and 104, as per FIG. 3B. Piece 101 is then coupled with piece 103 along their respective stepped edges, piece 103 being rotated by 180 degrees relative to piece 101, as in FIG. 9C, forming the beginning of a first row of paired units 40. Another row of slabs is then started under the paired pieces 101, 103, using piece 102, as per FIG. 9D. A new slab 10*iii* is then paired with piece 102, the slab 10*iii* being rotated by 180 degrees relative to piece 102, and coupled with piece 102 along the staggered edges, forming a new row 40*i* of slabs, as in FIG. 9E. The remaining piece 104 is then used to fit between the edge of the surface and the last row of slab 10*iii*. The installation can then be continued with uncut slabs, by assembling the slabs along their respective staggered and stepped sides. It will be appreciated that the configuration of the rows and of the indicators 54 allows reusing the remaining cut portions of the slabs to form the pavement, which in turn reduces waste and is more cost effective.

As can now be better appreciated, the slabs of the present invention have advantages over conventional discrete plank pavers known in the art. Merging several rows within a single slab enables providing rows longer than if individual plank pavers were used, while still meeting existing standards for load resistance and flexural strength capacities. Merging the rows in a single slab also allows providing rows with a single, uniform height, even though the rows have varying heights and width. The deployment of stepped/diagonal and staggered profiles allows for the joint pattern, formed when adjacent slabs and pairs of slabs are aligned, to be varied and non-linear, which contributes to the irregularity effect in a paved layout. The presence of transverse false joints provides an additional variant in the pattern of the layout, further improving irregularity. The varying width and length of the rows makes it difficult for an observer to spot identical rows in the layout, despite the fact that such identical rows are present. This can also contribute to the irregularity of the layout. Forming the slabs with five layers with a staggered and diagonal profile allows creating a sixth row when the units are paired, increasing the random pattern effect. Shifting adjacent rows of paired units also further increases the random effect of a paved surface. Units having five layers are also less heavy and therefore easier to manipulate by a single worker. The diagonal or stepped outline also facilitates clamping of the slabs during the manufacturing process. The staggered outline improves interlocking of the units, providing a more stable assembly than if the slabs only had a stepped profile. In addition, the paving slabs as proposed above are less likely to move or shift over time, as is common with individual plank pavers.

Although optional embodiments of the present invention have been described in detail herein and illustrated in the accompanying drawings, it is to be understood that the invention is not limited to these specific embodiments and that various changes and modifications may be effected without departing from the present invention.

The invention claimed is:

1. A plurality of paving slabs, each of said paving slabs comprising:

a unitary body made of concrete-based material, the body having sidewalls extending between top and bottom faces, providing the body with a thickness, the top face being provided with longitudinal false joints defining rows extending from a first side to a second side of the unitary body, the first and second sides being incongruent, said rows comprising top and bottom rows, the first side having a staggered outline with at least one recess and at least one tooth, the second side having a stepped outline from the top row to the bottom row, the first and second sides being able to couple with respective first and second sides of adjacent paving slabs, rotated by 180 degrees, the recess and tooth of the paving slab serving to interlock with the respective tooth and recess of one of the adjacent paving slabs, and the staggered and stepped outlines of the slabs creating an illusion, when the plurality of paving slabs are assembled on a surface, that the surface is covered by individual plank pavers randomly assembled.

2. The plurality of paving slabs according to claim 1, wherein the paving slabs have an identical outer contour.

3. The plurality of paving slabs according to claim 1, wherein at least some of the slabs have transverse false joints on their top face defining bars within a row.

4. The plurality of paving slabs according to claim 3, forming at least two different configurations of said paving slabs, the different configurations being determined by the location of the transverse false joints on the top face of the slabs.

5. The plurality of paving slabs according to claim 1, wherein each of the slabs comprises between four and six rows, the rows having respective lengths and widths, at least three of the lengths being different and at least two of the widths being different.

6. The plurality of paving slabs according to claim 5, wherein all of the lengths are different.

7. The plurality of paving slabs according to claim 5, wherein a pair formed by assembling a first one of the paving slabs with a second one of the paving slabs, rotated by 180 degrees, with both the first and second paving slabs comprising n rows, creates a set of n+1 rows.

8. The plurality of paving slabs according to claim 7, wherein the pair is formed by aligning the top row of the first paving slab with a row adjacent to the bottom row of the second paving slab.

9. The plurality of paving slabs according to claim 5, wherein a pair, formed by assembling a first one of the paving slabs with a second one of the paving slabs, rotated by 180 degrees, with both the first and second paving slabs comprising n rows, creates a set of n+2 rows.

10. The plurality of paving slabs according to claim 1, wherein each of the paving slabs comprise five rows, two of the rows having a first width, and two other (20*b*, 20*c*) of the rows having a second width, the remaining row having a third width; the first, the second and the third widths being different from one another.

11. The plurality of paving slabs according to claim 10, wherein the bottom row has the third width, the fourth row, adjacent to the bottom row, and the top row have the second width.

12. The plurality of paving slabs according to claim 1, wherein for each of the paving slabs, said at least one recess of the first side is formed between two teeth.

13. The plurality of paving slabs according to claim 1, wherein the outer contour has a shape reminiscent of a trapezoid.

14. The plurality of paving slabs according to claim 1, wherein the outer contour has a shape reminiscent of a triangle.

15. The plurality of paving slabs according to claim 1, wherein at least some of the paving slabs comprise at least one opening formed within at least one row, the at least one opening extending from the top face to the bottom face of the paving slabs.

16. The plurality of paving slabs according to claim 1, wherein for each of the paving slabs, the rows are sized, shaped and configured to create, when the plurality of paving slabs are assembled on the surface, openings in between the slabs.

17. The plurality of paving slabs according to claim 1, wherein at least some of the sidewalls are provided with spacers, said spacers having a width corresponding to a width of the longitudinal false joints.

18. The plurality of paving slabs according to claim 1, provided with indicators, said indicators indicating where to perform a line of cut in the paving slabs.

19. A paving slab comprising:

a unitary body made of concrete-based material, the body having sidewalls extending between top and bottom faces, providing the body with a thickness, the top face being provided with longitudinal false joints defining rows extending from a first side to a second side of the unitary body, the first and second sides being asymmetrical, said rows comprising top and bottom rows, the rows having respective lengths and widths, at least two of the widths being different, the first side having a staggered outline with at least one recess and at least one tooth, the second side having a stepped outline from the top row to the bottom row, the first and second sides being able to couple with respective first and second sides of adjacent slabs shaped as said paving slab, but rotated by 180 degrees, the recess and tooth of the paving slab serving to interlock with the respective tooth and recess of one of the adjacent paving slabs, and the staggered and stepped outlines of the slabs creating an illusion, when the slabs are assembled on a surface, that the surface is covered by individual plank pavers randomly assembled.

* * * * *